US006028038A

United States Patent [19]

Kusch

[11] Patent Number: 6,028,038

[45] Date of Patent: Feb. 22, 2000

[54] HALOGENATED EXTREME PRESSURE LUBRICANT AND METAL CONDITIONER

[75] Inventor: Kevin J. Kusch, Durant, Okla.

[73] Assignee: Charles L. Stewart, Virginia Beach, Va.

[21] Appl. No.: 09/023,512

[22] Filed: Feb. 13, 1998

Related U.S. Application Data

[60] Provisional application No. 60/038,392, Feb. 14, 1997.

[51] Int. Cl.[7] ..... C10M 141/04; C10M 129/66

[52] U.S. Cl. ..... 508/304; 508/463; 508/504

[58] Field of Search ..... 508/304, 463, 508/504

[56] References Cited

U.S. PATENT DOCUMENTS

| | | | |
|---|---|---|---|
| 2,210,140 | 8/1940 | Colbeth | 508/463 |
| 2,220,843 | 11/1940 | Johnson | 252/37 |
| 2,276,341 | 3/1942 | Prutton | 252/37 |
| 2,310,971 | 2/1943 | Lincoln et al. | 508/504 |
| 2,900,342 | 8/1959 | Manteuffel et al. | 508/304 |
| 2,959,552 | 11/1960 | Péras | 508/504 |
| 3,117,932 | 1/1964 | Péras | 508/504 |
| 3,816,346 | 6/1974 | Coppock et al. | 252/32.5 |
| 3,903,001 | 9/1975 | Gates et al. | 252/32.7 E |
| 3,970,570 | 7/1976 | Pratt et al. | 252/49.9 |
| 3,988,247 | 10/1976 | Dieckelmann | 252/8.7 |
| 4,076,642 | 2/1978 | Herber et al. | 508/304 |
| 4,244,829 | 1/1981 | Coupland et al. | 508/304 |
| 4,555,352 | 11/1985 | Garner et al. | 252/35 |
| 4,637,887 | 1/1987 | Worschech et al. | 252/56 R |
| 4,654,403 | 3/1987 | Tipton | 525/194 |
| 4,822,507 | 4/1989 | Kanamori et al. | 252/49.5 |
| 4,844,825 | 7/1989 | Sloan | 252/40.7 |
| 4,990,273 | 2/1991 | Croudace | 252/46.4 |
| 5,151,485 | 9/1992 | Treybig et al. | 528/87 |
| 5,368,776 | 11/1994 | Schafer et al. | 252/395 |
| 5,783,528 | 7/1998 | Rodenberg | 508/463 |

*Primary Examiner*—Jerry D. Johnson
*Attorney, Agent, or Firm*—Sheldon H. Parker

[57] ABSTRACT

An extreme pressure lubricant additive system, is provided for use in lubricating metal wear surfaces, such as the transmission or engine of an automobile. The additive system is added to the oil reservoir of the transmission, engine or the like. The additive system includes in combination, a naphthenic base oil, a chlorinated methyl ester, a methyl ester anti-wear additive, and an acid scavenger. The extreme pressure lubricant additive system is present in a minor quantity and said lubricating oil is present in a major quantity, on a weight percent basis. The naphthenic base oil is from about 15 to 30 percent of said additive system, and preferably from about 18 to 25 percent of the additive system. The methyl ester anti-wear additive is from about 2 to 7 percent of the additive system, and preferably 4 to 6 percent of said system. The chlorinated methyl ester is present in the range from about 50 to 90 percent, and preferably in the range from about 60 to 80 percent. About 1 to about 3 percent of an epoxidized soy bean oil is employed in the system, as an acid scavenger and/or stabilizer, preferably in an amount from about 1.5 to about 2.5 percent of the additive system. More preferably the acid scavenger is from about 1 to about 3 percent of an epoxidized triglyceride.

20 Claims, No Drawings

HALOGENATED EXTREME PRESSURE LUBRICANT AND METAL CONDITIONER

This application claims the benefit of U.S. Provisional Application No. 60/038,392 filed on Feb. 14, 1997.

FIELD OF THE INVENTION

This invention relates to the field of lubricants, and in particular to extreme pressure lubricants for motors, pumps and similar applications, and to lubricant additive systems for synthetic and natural oils.

BACKGROUND OF THE INVENTION

Special lubricant systems have been developed over the years to reduce friction and prevent wear and welding between working surfaces of bearing and gear teeth when, as a result of extreme pressure, low speed, high temperatures or reduced viscosity, the film which normally completely separates moving parts becomes thin enough to permit partial metal-to-metal contact. When moving machine parts are subjected to severe conditions of load, speed and temperature, as for example, the high tooth pressures and high rubbing velocities often encountered in hypoid and spurtype gearing, base lubricating oils themselves do not have the necessary qualities to provide adequate lubrication; metal-to-metal contact would occur which results in scoring, galling and local seizure of the gear teeth; therefore it is necessary to employ lubricants which contain extreme pressure additives. Extreme pressure (EP) additives are a special class of boundary lubrication additives which chemically react with the metal surface to form compounds with lower shear strength than the metal. The resultant lowshear compound thus provides the requisite lubrication. EP oils are basically inhibited oils with added extreme pressure additives.

SUMMARY OF THE INVENTION

An extreme pressure lubricant additive system, is provided for use in lubricating metal wear surfaces, such as the transmission or engine of an automobile. The additive system is added to the oil reservoir of the transmission, engine or the like. The additive system includes in combination, a naphthenic base oil, a chlorinated methyl ester, a methyl ester anti-wear additive, and an acid scavenger.

The extreme pressure lubricant additive system is present in a minor quantity and said lubricating oil is present in a major quantity, on a weight percent basis. Obviously, the additive must be present in an efficacious amount, which is typically, up to about five percent of the total oil, natural or synthetic in the system.

The naphthenic base oil is from about 15 to 30 percent of said additive system, and preferably from about 18 to 25 percent of the additive system. The methyl ester anti-wear additive is from about 2 to 7 percent of the additive system, and preferably 4 to 6 percent of said system. The chlorinated methyl ester is present in the range from about 50 to 90 percent, and preferably in the range from about 60 to 80 percent. About 1 to about 3 percent of an epoxidized soy bean oil is employed in the system, as an acid scavenger and/or stabilizer, preferably in an amount from about 1.5 to about 2.5 of the additive system. More preferably the acid scavenger is from about 1 to about 3 percent of an epoxidized triglyceride.

Percentages referred to are on a weight basis, unless specified otherwise.

The method of protecting working surfaces of metal components against wear due to friction, comprising lubricating the metal surfaces with a typical, commercially available oil lubricant, and enhancing the lubricating effect of said oil lubricant, by adding to said oil lubricant, a minor amount of an extreme pressure lubricant additive system in the concentrations and compositions defined above.

DETAILED DESCRIPTION OF PREFERRED EMBODIMENTS

The instant invention is an extreme pressure lubricant/compound. The current embodiments of the instant invention contain no solids, no heavy metal resins, blends fully and does not separate, and has non-corrosive and anti-corrosive properties. It is designed to be usable in car engines (including diesel engines), Gearboxes (worm and planetary), transmissions (manual and automatic), bearings and shafts, machining (cutting, drilling, and extruding), compressors (reciprocal and rotary vein), pumps (centrifugal and reciprocating).

In the production of lubricants numerous substances, for example, ample, oleic acid, tricresyl phosphate, sulphur bearing compounds, sperm oil and sulfurized sperm oil, may be added to the base lubricant to contribute various properties or characteristics to the finished lubricant. The terms extreme pressure, film strength properties, and also oiliness and lubricity refer to the ability of lubricants to reduce friction and prevent wear and welding between working surfaces of bearings and gear teeth when, as a result of extreme pressure, low speed, high temperatures or reduced viscosity, the film which normally completely separates moving parts becomes thin enough to permit partial metal-to-metal contact. When moving machine parts are subjected to more severe conditions of load, speed and temperature, as for example, the high tooth pressures and high rubbing velocities often encountered in hypoid and spurtype gearing, base lubricating oils themselves do not have the necessary qualities to provide adequate lubrication; metal-to-metal contact would occur which results in scoring, galling and local seizure of the gear teeth; therefore, it is necessary to employ lubricants which contain extreme pressure additives. Conventionally employed additives of this type, and also additives for imparting anti-wear properties to the lubricants, are generally phosphorus, chlorine and/or sulfur compounds which react with metal surfaces to reduce friction and prevent welding.

Numerous lubricant compositions which contain anti-wear agents and/or extreme pressure additives are known, and have been described in various patents and other literature. For instance, Johnson describes in U.S. Pat. No. 2,220,843 an extreme pressure lubricant which comprises a major proportion of a refined lubricating oil and as additives, a sulfurized ester of an unsaturated acid and a heavy metal naphthenate.

While many elements and compounds are mentioned in the prior art, there is no reference as to which combinations are most effective. Each prior patent discloses a discreet set of combinations that tends to have all of its component elements listed in its prior art. However, the components are often used for a different purpose or in a different combination. Thus, the mere mention of a chemical in the prior art does not make it known for the current use or for the current combination.

The instant EP lubrication/compound forms a bond that modifies surfaces to provide constant protection. Lubricating compositions reduce friction and reduce or prevent destructive contact between moving metal surfaces as long as a lubricating film is maintained between the moving surfaces. This particular type of lubrication is referred to as hydrodynamic lubrication.

Some anti-wear additives enhance the hydrodynamic lubrication of motor oils and the like. However, when the pressure and/or rubbing speeds between the moving metal surfaces increase, the lubricating film is forced out from between the moving metal surface. This results in metal to metal contact and wear. Lubrication under these extreme pressure conditions requires an additive that is adsorbed by or reacts with the metal to form an adherent protective film having a lower shear strength with the metal. The type of lubrication that is needed under these conditions is called boundary lubrication, and additives enhancing this type of lubrication are known as extreme pressure, anti-wear additives. Synthetic lubricants, which are used as a base, provide superior boundary lubrication to maintain lubrication.

The instant invention uses napthenic oil as its base oil. The napthenic base oil provides a low temperature viscosity-reducing liquid diluent which gives the mixture desirable low temperature properties. Good low temperature fluidity eases cold weather starting and insures that the hydraulic control system will properly shift gears.

The EP agents reduce friction temperatures and allow lubricant to remain in and on surfaces. Extreme pressure (EP) additives are a special class of boundary lubrication additives which chemically react with the metal surface to form compounds with lower shear strength than the metal. The resultant lowshear compound thus provides the requisite lubrication. EP oils are basically inhibited oils with added extreme pressure additives. The EP agent serves to control wear in the boundary lubrication phase; namely, starting stopping, shock loading and the like. If high points of mating surfaces come in contact during machine operation, the lower shear strength EP compound will shear, rather than fuse and cause scoring; thus, controlled wear is exchanged for destructive wear. EP additives find utility in greases, industrial oils and gear lubes.

There is no teaching in the prior art to the combination used in the instant invention or in its ability to get dramatically superior results. However, there is some teaching on the properties of individual components.

Epoxidized soy bean oil is used in the instant invention as a stabilizer and acid scavenger. The properties of the epoxidized soybean oil are:

| Properties | Typical |
|---|---|
| Physical State | Amber liquid |
| Weight per Gallon | 8.25 |
| Specific Gravity, 25C. | 0.992 |
| Viscosity, Gardner | N |
| Color, APHA | 110 |
| Pour Point | 25 F. |
| Refractive Index | 1.472 |
| Toxicity | Non-Toxic |
| Iodine Value, 2.0 maximum | 1.2 |
| Acid Value, 0.5 maximum | 0.3 |

| | Specification | Typical |
|---|---|---|
| Raw Material Base | Alkali refined | Alkali refined |
| % Oxirane Value | 6.8 minimum | 7.0 |
| Iodine Value | 2.0 maximum | 1.2 |
| Acid Value | 0.5 maximum | 0.3 |

The instant invention uses a chlorinated methyl ester of a tallow based fatty acid to obtain better lubricity than conventional chlorinated waxes.

| CW 80 E | |
|---|---|
| Property | Typical |
| Chlorine, % | 34 |
| Acid Value | 2 |
| Viscosity, SUS @ 100 F. | 720 |
| Viscosity, SUS @ 210 F. | 64 |
| Viscosity, SUS @ 40 C. | 135 |
| Viscosity, SUS @ 100 C. | 11 |
| Color, ASTM | 1.5 |
| Specific Gravity @ 25 C. | 1.16 |
| Pounds per Gallon @ 77 F. | 9.6 |
| Pour point F (C.) | <10 (<−12) |

The instant invention also uses methyl esters, also known as "Methyl Lardate" that are not fat based because of their superior lubrication properties relative to conventional fats. Methyl esters are considered to be an anti-wear additive which can also be used as a process and release additive. Solubility varies with the selection of base oils. Methyl esters are good oilness additives that offer better metal wetting and lubrication properties than conventional fats. Their primary uses include addition to soluble oils, gasoline top oils, motor oils, and rolling oils. The Methyl used here have the following properties:

| BASE ML | |
|---|---|
| Property | Typical |
| Saponification Value, mg KOH/g | 195 |
| Acid Value, mg KOH/g | 1 |
| Color, ASTM (gardner) | 1(2) |
| MIU% | 1 |
| Viscosity, SUS 100 F. | 42 |
| Viscosity, cSt, 40 C. | 4.5 |
| Cloud Point F. (C.) | 52 (11) |
| Specific Gravity 25 C. | 0.88 |
| Pounds/Gallon 77f | 7.2 |
| Flash Point, C.O.C., F. (C.) | 335(168) |
| Pour Point, F.(C.) | 50 (10) |

The preferred embodiment of the invention is as follows (measured by weight):

| | |
|---|---|
| Naphthenic base oil | 22% |
| Epoxidized soy bean oil | 2% |
| Methyl ester | 5% |
| Chlorinated Methyl Ester | 71% |

The range can be about as follows:

| | |
|---|---|
| Naphthenic base oil | 15 to 30% |
| Epoxidized soy bean oil | 1 to 3% |
| Methyl ester | 2 to 7% |
| Chlorinated Methyl Ester | 50 to 90% |

More preferably the range can be about, as follows:

| | |
|---|---|
| Naphthenic base oil | 18 to 28% |
| Epoxidized soy bean oil | 1.5 to 2.5% |
| Methyl ester | 4 to 6% |
| Chlorinated Methyl Ester | 60 to 80% |

This embodiment improves fuel economy, increases horsepower and torque, reduces heat due to friction, aliments excessive wear from dry starts, protects equipment from contamination, lowers maintenance costs, extends equipment life cycle and imparts long lasting protection.

Methods of Testing

Extreme Pressure Testing Method

The effectiveness of an extreme pressure lubricant can be readily demonstrated using an extreme pressure testing machine. The use of such a machine is explained in U.S. Pat. No. 4,844,825. This machine utilizes an electric motor to rotate a steel bearing race. A stationary steel bearing is brought into contact with the rotating bearing race. This is done by removably inserting the bearing into the end of a rotating arm which is allowed to rest in contact with the rotating bearing. The arm is in turn levered by a second rotating bearing. To the end of which weights may be applied. The effect of the arrangement of the arms is to provide weight at the end of the latter arm which is greatly magnified through the principle of the lever through to the point of contact with the rotating bearing race. Because of the small area of contact, a very great pressure is applied by the stationary bearing to the rotating bearing race. The bearing race is initially allowed to rotate in a bath of a standard motor oil, and the end of the arm with the test bearing is allowed to rest on the rotating race without additional pressure. On examination of the test bearing, it is found that a small scar, approximately one millimeter in width is formed in the surface of the bearing due to the friction. The test bearing is then rotated to apply a fresh surface to the bearing race, and again the test bearing is allowed to contact the rotating race, only this time a weight of approximately four pounds is applied to the end of the multiple lever apparatus to apply more pressure to the point of contact. Upon examination of the test bearing, a large scar has been formed in the surface of the bearing, approximately four millimeters in width.

The procedure is then repeated, only an amount of the extreme pressure lubricant additive of the invention is added to the motor oil bath in which the bearing race is rotating. Again, the test bearing is rotated to present a fresh surface to the bearing race and is allowed to rest in contact against the rotating race without additional pressure.

Example of a Test Using the Extreme Pressure Testing Machine

Upon examination of the test bearing, it is found that the initial amount of scarring has been greatly reduced. When the test is repeated with a four pound (1.81 kg.) weight at the end of the lever mechanism, the scarring is still less than was present in the initial oil-only situation without additional pressure, with the scar now being less than one millimeter in width. Indeed, rather than being a deep gouge out of the surface of the bearing, as was the case with the oil-only bath, the point where the test bearing contacted the bearing race rotating in the oil with additive bath appears to the eye to be a small polished area on the surface of the bearing. Even if the weight at the end of the lever mechanism is increased by a factor of six from the four pound (1.81 kg.) weight the size of the scar on the test bearing does not increase significantly and still is not significantly greater in width then was the case with the oil-only bath where no additional pressure was added. Indeed, the surface of the scar is shown to be polished compared to the pitted scar present in the oil only bath.

Falex Lubricant Tester and Shell 4-Ball EP Lubricant Testing Methods

The anti-wear properties of different blends can be compared using two different wear testers, the Falex Lubricant Tester and the Shell 4Ball E.P. Lubricant Testing Apparatus. Both of these testers are known to workers in the field of lubrication, and are described in U.S. Pat. No. 3,970,570.

Shell 4-Ball Apparatus

In the Shell 4Ball apparatus, three steel balls, covered by the lubricant to be tested, are held tightly in a circular holder, and a fourth ball, held in a movable chuck, is lowered until it contacts the other three. A load is applied to the fourth ball by means of a lever arm to which the appropriate weights are attached; and then the fourth ball is rotated against the other three at a speed of 1750 rpm for the desired period of time. If the lubricant fails completely, the four balls will be welded together; otherwise, circular scars will be left on each ball at the point of contact, the diameter of which will be proportional to the amount of wear that has occurred.

Example Test for the Shell 4-Ball Apparatus

In the evaluation of the anti-wear additive mixture of an invention, the Shell 4 ball apparatus was run for one hour with a load of 40 kilograms; and the numbers reported in the Tables and text are the average of the diameters of the scars on the four balls.

Falex Apparatus

In the Falex apparatus, pressure is applied on opposite sides of a rotating steel pin by two V-shaped blocks held by two movable arms and immersed in a container of the lubricant or grease to be tested. The pin and blocks are weighed before and after the test, and the amount of weight loss is a measure of the amount of wear that has occurred.

Example Test for the Falex Apparatus

In the Falex tests reported, a pressure of 600 psig was applied on the pin for a period of one hour. This resulted in a 2% weight loss of the pin as compared to the 25% weight loss of the untreated pin.

Chemical Properties

The disclosure of the U.S. Pat. Nos. 3,988,247, 3,816,346, 5,151,485, 4,637,887, 4,844,825, 4,822,507, 4,555,352, 2,220,843, 5,368,776, 2,276,341, 4,990,273, 4,654,403, and 3,903,001 are incorporated herein by reference thereto as though recited in full. These patents are noted to contain disclosures as to the compositions of materials which are employed in the present invention, rather than disclosures of the relevancy of these materials in the formulation of the instant invention.

U.S. Pat. No. 4,844,825 describes some of the properties embodied in chlorinated paraffins. Chlorine based compounds, such as those chlorine derivatives of paraffinic hydrocarbon compounds referred to as chlorinated paraffins, can serve as lubricant additives to improve the performance of the lubricant under extreme pressure. Under normal lubricating conditions, the two metal surfaces will be separated by a thin film of lubricant which provides the required reduction in friction. Under situations of extreme pressure between the two metal surfaces, all the liquid lubricant is forced from the area of contact between the surfaces. Where an extreme pressure additive such as chlorinated paraffin is present, however, it has been found that the resultant heat generated between the two surfaces causes chlorine atoms to be liberated from the additive and to combine with the surface metals, such as iron, to form a chloride, such as iron chloride. This surface coating of chloride has a much lower coeficient of friction than the dry metal surface. The iron chloride surface coating tends to fill in depressions in the surfaces, resulting in smoother surfaces at the point of interaction and reduced friction wear.

Chlorinated paraffins have been used as extreme pressure additives in such applications as metalworking. However, the corrosive nature of chlorinated paraffins have made them generally unsuitable for use in internal combustion engine applications or other corrosion sensitive applications. Under heating, the chlorinated paraffins release hydrochloric acid, which is corrosive.

Some properties of naphthenic oil are discussed in U.S. Pat. No. 4,822,507 which teaches the use of naphthenic oil in a lubricating oil composition. At least one oil selected from the group consisting of a mineral oil and a synthetic oil is used in '507. This component is a base material of the lubricating oil composition. There are no special limitations to these mineral and synthetic oils. It is, however, preferred to use a mineral oil and/or a synthetic oil having a viscosity of 5 to 55 centistokes (cst) as determined at 40 C. Typical examples of the mineral oil are a lubricating oil fraction of naphthenic, intermediate and paraffinic mineral oils, and a high aromatic component as obtained by decomposition of such mineral oils.

A discussion of anti-wear agents and/or extreme pressure additives used in other patents and literature is provided in U.S. Pat. No. 4,555,352. For instance, Johnson describes in U.S. Pat. No. 2,220,843 a lubricant which comprises a major proportion of a refined lubricating oil and as additives, a sulfurized ester of an unsaturated acid and a heavy metal naphthenate. The '352 patent also mentions U.S. Pat. No. 2,276,341 (Prutton) where a lubricant is described, which comprises a hydrocarbon lubricating oil, from about 1% to about 5% of a metal naphthenate or naphthenic acid ester, and any one of a wide variety of halogenated organic compounds. The '352 patent also refers to naphthenic 5% to 40% by weight of diesel oil, or of a hydrocarbon oil having physical characteristics comparable to said diesel oil; said composition functioning both as a friction reducing agent and as an extreme pressure (EP) additive. This heavy duty formulation may also (desirably) include 0.10% to 5.00% by weight of an oil soluble zirconium containing soap selected from the group consisting of zirconium naphthenate, zirconium 2 ethylehexanoate, zirconium, 3,5 dimethyl hexanoate, and zirconium neodecanoate, or mixtures thereof.

Additives which may give good low temperature properties are discussed in U.S. Pat. No. 4,990,273. These include substantially all oleaginous materials such as lubricating oils or greases derived from mineral or synthetic oil or mixtures thereof. Lubricating oils may be of the naphthenic or paraffinic types, with mineral and synthetic oil of any suitable lubricating viscosity useful for the purposes of the present invention. In the case of greases, substantially any grease, e.g., metal soap grease, is improved in respect to its anti-wear properties and extreme pressure characteristics by the use of the additive of the invention. The preferred oleaginous materials are lubricating oils for use in gasoline powered internal combustion engines, i.e., motor oils.

The use of naphthenic oil as a low temperature additive is taught by U.S. Pat. No. 4,654,403 with regards to problems associated with the lubrication of automatic and manual transmissions and the operation of hydraulic fluid systems as well known to those skilled in the art. For example, in the lubrication of transmissions, proper fluid viscosity at both low and high temperatures is essential to successful operation. Good low temperature fluidity eases cold weather starting and insures that the hydraulic control system will properly shift gears. An effective amount of at least one low temperature viscosity reducing liquid organic diluent such as a naphthenic oil or certain other natural and synthetic oils having the desired low temperature properties can be used to improve temperature sensitive properties.

Naphthenic oil may also be used as a diluent along with any other organic diluent having the desired viscosity reducing characteristics. Such diluents may be natural or synthetic diluents. Among the preferred organic diluents exhibiting the desirable viscosity characteristics are the naphthenic oils, certain synthetic oils and alkylated aromatic materials. The naphthenic oils which are useful in the compositions of the '403 invention are those derived from naphthenic crudes such as found in the Louisiana area. The viscosity of such naphthenic oils at 40 C. generally is less than 4 centistokes and more generally within the range of from about 3.0 to about 3.8 centistokes. At 100 C., the viscosity of the desirable naphthenic crudes is within the range of about 0.8 to about 1.6 centistokes. Such naphthenic oils have been found to provide excellent fluidity characteristics to the polymeric compositions of the invention, particularly at low temperature U.S. Pat. No. 3,903,001 teaches the use various oils, including naphthenic oil, as useful lubricants for a controlled slip differential, and which are also useful for lubrication of a traction drive transmission.

The use in this lubricant of high and low viscosity fractions of the naphthene and paraffin is an example of dumbell blending to improve viscosity index.

One of the few references to a chlorinated fatty acid methyl ester is in U.S. Pat. No. 3,988,247 which deals with lubricating agents for leather and furs and process. To produce the lubricant used in the instant invention, it is preferred to start with naturally occurring higher fatty acids or esters of higher fatty acids having from 8 to 24, preferably 10 to 20, carbon atoms. Mixtures of fatty acids or fats or oils as present in naturally occurring aliphatic substances, especially those with a share of singly or repeatedly unsaturated fatty acids are preferred. Preferably the starting material is a fatty acid compound selected from the group consisting of higher fatty acids having from 8 to 24 carbon atoms, esters of said higher fatty acids with alcohols selected from the group consisting of alkanols having 1 to 24 carbon atoms, alkanediols having 2 to 6 carbon atoms, alkanetriols having 3 to 6 carbon atoms, alkanetetraols having from 4 to 6 carbon atoms and alkanehexaols having 6 carbon atoms, and naturally occurring fats, oils and waxes containing fatty acids having 8 to 24 carbon atoms. Examples of such fatty acid compounds are coconut oil, soybean oil, cottonseed oil, rapeseed oil, linseed oil, castor oil, sunflower seed oil, olive oil, neat's foot oil, peanut oil, herring oil, cod liver oil, shark liver oil, whale oil, tallow fat or lard, furthermore the fatty acid mixture obtained from these fats or oils, and the naturally occurring wax esters such as sperm oil. But even aliphatic fatty acid compounds containing no unsaturated fatty acids or with a reduced content of unsaturated fatty acids such as the saturated fats obtained by pressing, crystallization or distillation, or partially or completely hardened fats or oils can be utilized as starting materials.

Also, suited as raw materials for the manufacture of the lubricants are synthetically produced esters of saturated or unsaturated fatty acids having from 8 to 24, preferably 10 to 20, carbon atoms, such as decanecarboxylic acid, palmitic acid, stearic acid, behenic acid, dodecenecarboxylic acid, oleic acid, linoleic acid or alkanoic acids produced by paraffin oxidation, with mono- or poly-hydric aliphatic alcohols having form 1 to 6 carbon atoms, such as methanol, ethanol, isopropanol, butanol, ethylene glycol, 1,2-propylene glycol, glycerin, pentaerythritol or sorbitol, or higher alcohols having 8 to 24 carbon atoms, such as decylalcohol or oleyalcohol.

Due to their ready availability the natural animal or vegetable fats, oils or waxes and the products obtained from ester interchange with lower alkanols, in particular, methyl alcohol, and the corresponding fatty acid mixtures are preferred as raw materials.

Epoxidized oils are disclosed in the context of lubricants for vinyl chloride polymers in U.S. Pat. No. 4,637,887. The triglycerides used in accordance with epoxides are a class of chemical compounds known per se which may be produced by conventional methods of organic synthesis. Suitable starting materials for producing the triglycerides containing hydroxy fatty acid residues are natural fats and oils of which the fatty acid content consists to a large extend of mono-and polyunsaturated fatty acids. Examples of suitable starting materials are at least one of olive oil, linseed oil, palm oil, tall oil, lard oil, herring oil and whale oil. Soybean oil, rapeseed oil and tallow, or their mixture, are particularly preferred.

The patent indicates that the lubrication effect of the hydroxy fatty acid triglycerides may be utilized in the molding f any thermoplastics polymers of which the principal constituent is vinyl chloride. While the application of the compound is not directly related to that of the present invention, the disclosure thereof, is of interest with respect to its disclosure of triglyceride compositions.

U.S. Pat. No. 5,151,485 provides information relating to expoxidized triglycerides of a fatty acid. For example, the patent disclosed expoxidized triglycerides of fatty acids as including those which contain an average of more than one expoxidized triglycerides of fatty acids. Expoxidized fatty acids can include expoxidized, linileic acid, linolenic acid, arachidonic acid, licanic acid, and combinations thereof.

U.S. Pat. No. 3,816,346 contains disclosure of methyl esters of a triglyceride of a fatty acid. The disclosure of '346 indicates that hydrorefined oil can be of a naphthenic class.

What is claimed is:

1. An extreme pressure lubricant additive system, comprising, in combination, a naphthenic base oil, a chlorinated methyl ester, a methyl ester anti-wear additive, and an acid scavenger consisting of an epoxidized natural oil.

2. The extreme pressure lubricant additive system of claim 1, further comprising a lubricating oil, wherein said additive system is present in a minor quantity and said lubricating oil is present in a major quantity, on a weight percent basis.

3. The extreme pressure lubricant additive system of claim 2, where said additive system comprises from about 22 percent of said naphthenic base oil, about 5 percent of said methyl ester anti-wear additive, about 70 percent of said chlorinated methyl ester, and about 2 percent of an epoxidized natural oil as said acid scavenger.

4. The extreme pressure lubricant additive system of claim 3, wherein said acid scavenger is an epoxidized triglyceride.

5. The extreme pressure lubricant additive system of claim 1, where said naphthenic base oil comprises from about 15 to 30 percent of said additive system.

6. The extreme pressure lubricant additive system of claim 1, where said naphthenic base oil comprises from about 18 to 25 percent of said additive system.

7. The extreme pressure lubricant additive system of claim 1, wherein said methyl ester anti-wear additive comprises from about 2 to 7 percent of said additive system.

8. The extreme pressure lubricant additive system of claim 1, wherein said methyl ester anti-wear additive comprises from about 4 to 6 percent of said additive system.

9. The extreme pressure lubricant additive system of claim 1, where said chlorinated methyl ester is present in the range from about 50 to 90 percent.

10. The extreme pressure lubricant additive system of claim 1, where said chlorinated methyl ester is present in the range from about 60 to 80 percent.

11. The extreme pressure lubricant additive system of claim 1, where said naphthenic base oil comprises from about 18 to 25 percent of said additive system, said methyl ester anti-wear additive comprises from about 4 to 6 percent of said additive system, said chlorinated methyl ester is present in the range from about 60 to 80 percent, and from about 1.5 to about 2.5 percent of an epoxidized natural oil.

12. The extreme pressure lubricant additive system of claim 11, further comprising a lubricating oil, wherein said additive system is present in a minor quantity and said lubricating oil is present in a major quantity, on a weight percent basis.

13. The extreme pressure lubricant additive system of claim 12, wherein said lubricant additive system is present in an amount up to about 5 percent of said lubricating oil.

14. The extreme pressure lubricant additive system of claim 13, wherein said lubricating oil is a synthetic oil.

15. The extreme pressure lubricant additive system of claim 1, where said acid scavenger is present in the range from about 1 to about 3 percent as an epoxidized soy bean oil.

16. The extreme pressure lubricant additive system of claim 1, where said acid scavenger is present in the range from about 1.5 to about 2.5 percent as an epoxidized soy bean oil.

17. The extreme pressure lubricant additive system of claim 1, where said acid scavenger is present in the range from about 1 to about 3 percent as an epoxidized triglyceride.

18. The method of protecting working surfaces of metal components against wear due to friction, comprising lubricating said metal surfaces with an oil lubricant, and enhancing the lubricating effect of said oil lubricant, by adding to said oil lubricant, a minor amount of an extreme pressure lubricant additive system, said lubricant additive system comprising a naphthenic base oil, a chlorinated methyl ester, a methyl ester anti-wear additive, and an acid scavenger consisting of an epoxidized natural oil.

19. The method of claim 18, where said naphthenic base oil comprises from about 18 to 25 percent of said additive system, said methyl ester anti-wear additive comprises from about 4 to 6 percent of said additive system, said chlorinated methyl ester is present in the range from about 60 to 80 percent, and from about 1.5 to about 2.5 percent of an epoxidized natural oil.

20. The method of claim 18, comprising adding a sufficient quantity of said lubricant additive system in an amount up to about 5 percent of said lubricating oil, to provide extreme pressure lubrication to said working surfaces.

* * * * *